US008967898B1

(12) United States Patent
Dayeh

(10) Patent No.: US 8,967,898 B1
(45) Date of Patent: Mar. 3, 2015

(54) MULTI-FUNCTION BACK AND BODY SCRUBBER

(71) Applicant: Jack Dayeh, Laguna Niguel, CA (US)

(72) Inventor: Jack Dayeh, Laguna Niguel, CA (US)

( * ) Notice: Subject to any disclaimer, the term of this patent is extended or adjusted under 35 U.S.C. 154(b) by 0 days.

(21) Appl. No.: 14/105,826

(22) Filed: Dec. 13, 2013

(51) Int. Cl.
*A46B 11/02* (2006.01)
*A47K 7/02* (2006.01)
*A47K 7/03* (2006.01)

(52) U.S. Cl.
CPC . *A47K 7/028* (2013.01); *A47K 7/03* (2013.01); *A47K 7/022* (2013.01)
USPC ..... 401/188 R; 401/6; 401/23; 401/25; 401/37

(58) Field of Classification Search
CPC .. A45D 2200/1081; A47L 13/12; B05C 9/04; B05C 9/045; B05C 9/08; B05C 9/10; B05C 9/12; B05C 17/00569; B05C 17/00583
USPC ..... 401/6, 188 R, 16, 18, 23, 24, 25, 26, 36, 401/37
See application file for complete search history.

(56) References Cited

U.S. PATENT DOCUMENTS

| | | | | |
|---|---|---|---|---|
| 2,800,673 | A * | 7/1957 | Lazisky | 401/188 R |
| 6,129,469 | A | 10/2000 | Messer et al. | |
| 6,210,057 | B1 | 4/2001 | Yannaci et al. | |
| 6,412,997 | B2 * | 7/2002 | Berke et al. | 401/6 |
| 6,543,954 | B2 | 4/2003 | Owings | |
| 6,616,364 | B2 * | 9/2003 | Katz et al. | 401/6 |
| 6,817,801 | B1 * | 11/2004 | Colburn et al. | 401/205 |
| 6,983,866 | B2 | 1/2006 | Smart et al. | |
| 7,037,016 | B1 * | 5/2006 | Nelson | 401/6 |
| 7,431,525 | B2 | 10/2008 | Anderson | |
| 2006/0008313 | A1 | 1/2006 | Wisniewski | |
| 2009/0092435 | A1 | 4/2009 | Stevens | |

* cited by examiner

*Primary Examiner* — David Walczak
(74) *Attorney, Agent, or Firm* — Morland C. Fischer

(57) ABSTRACT

A multi-function back and body scrubber to enable a user to wash, scrub, massage and exfoliate his back and other areas of his body while taking a bath or a shower. The multi-function scrubber includes a shaft that is filled with fluid (e.g., body wash), a flexible thumb pump detachably connected to one end of the shaft, and a double-sided scrubbing head connected to the opposite end. The scrubbing head has first and second cleaning surfaces (e.g., a loofah sponge and a plurality of raised bumps) that are detachable and interchangeable with one another. When the thumb pump is squeezed, fluid is forced from the shaft to one of the cleaning surfaces of the double-sided scrubbing head. The scrubbing head is detachable from the shaft to be held in a hand of the user so that fluid can be dispensed from the shaft thereto.

13 Claims, 4 Drawing Sheets

MULTI-FUNCTION BACK AND BODY SCRUBBER

BACKGROUND OF THE INVENTION

1. Field of the Invention

This invention relates to a multi-function back and body scrubber including an elongated shaft having a fluid reservoir filled with a body wash or the like and a double-sided scrubbing head attached to the shaft so as to reach a user's back while taking a bath or a shower. In a preferred embodiment, the double-sided scrubbing head is detachable from the shaft to be held in the user's hand in order to wash or scrub other areas of the user's body.

2. Background Art

It is often difficult for an individual taking a bath or shower to be able to wash his/her back. In cases where another individual is not present, the first individual's back may go substantially unwashed. To this end, soap dispersers are known having an elongated handle or shaft by which to enable a user to apply a self-contained supply of body wash to hard-to-reach areas of his/her back. However, the use of such conventional body wash applicators is limited. More particularly, the user may want to be able to wash, scrub, massage and exfoliate different areas of his/her body without having to change applicators. In situations where the user does not need a long handle or shaft to reach certain areas of his/her body, the conventional body wash applicators are typically incapable of being disassembled and reduced to a compact, easy-to-hold size by eliminating the handle or shaft therefrom. Accordingly, what would be desirable is an improved multi-function back and body scrubber which overcomes the limitations described above.

SUMMARY OF THE INVENTION

In general terms, a multi-function back and body scrubber is disclosed to enable a user to selectively wash, scrub, massage and exfoliate his back and other areas of his body while taking a bath or a shower. The multi-function scrubber includes an elongated shaft that is sized to reach the back of the user, a flexible thumb pump detachably connected to one end of the shaft, and a double-sided scrubbing head detachably connected to the opposite end. The shaft has a fluid reservoir running therethrough. The fluid reservoir is filled with fluid (e.g., body wash or body lotion) to be delivered to the double-sided scrubbing head when the thumb pump is compressed (i.e., squeezed) by the user. The thumb pump can be separated from the shaft when it is necessary to gain access to and refill the fluid reservoir with fluid.

The double-sided scrubbing head of the multi-function back and body scrubber includes an intermediate cleaning surface holder. A hollow fluid channel extends longitudinally through the cleaning surface holder. The fluid channel is sized and shaped to slidably and removably receive a fluid reservoir extension that projects from the shaft and is coupled to the fluid reservoir thereof. The fluid reservoir extension has a pair of locking tabs that are rotated into locking engagement with respective ones of a pair of twist-in locking slots formed in the fluid channel of the intermediate cleaning surface holder of the scrubbing head. Accordingly, the double-sided scrubbing head is detachably connected to the shaft of the body and back scrubber to establish a fluid path between the fluid reservoir of the shaft and the fluid channel of the cleaning surface holder by way of the fluid reservoir extension. A normally closed fluid actuator extends across the fluid reservoir extension to control the flow of fluid between the fluid reservoir of the shaft and the fluid channel of the cleaning surface holder.

First and second cleaning surfaces, preferably manufactured from different materials and having different cleaning applications, are detachably connected to opposite sides of the intermediate cleaning surface holder of the double-sided scrubbing head. By way of example, the first cleaning surface is a loofah sponge, and the second cleaning surface includes a set of upstanding bristles or raised bumps. The first and second cleaning surfaces are detachably and interchangeably connected to the intermediate cleaning surface holder by means of flat attachment bases thereof being slidably received by respective retention grooves located below and above the fluid channel through the cleaning surface holder. When the thumb pump is squeezed, fluid under pressure is supplied from the fluid reservoir of the shaft, through the fluid reservoir extension, whereby to open the fluid actuator of the fluid reservoir extension, for receipt by the first cleaning surface (e.g., loofah sponge). When it is separated from the shaft, the double-sided scrubbing head of the multi-function back and body scrubber can be held in the user's hand to wash and scrub other areas of the user's body.

DESCRIPTION OF THE PREFERRED EMBODIMENT

Figure 1:
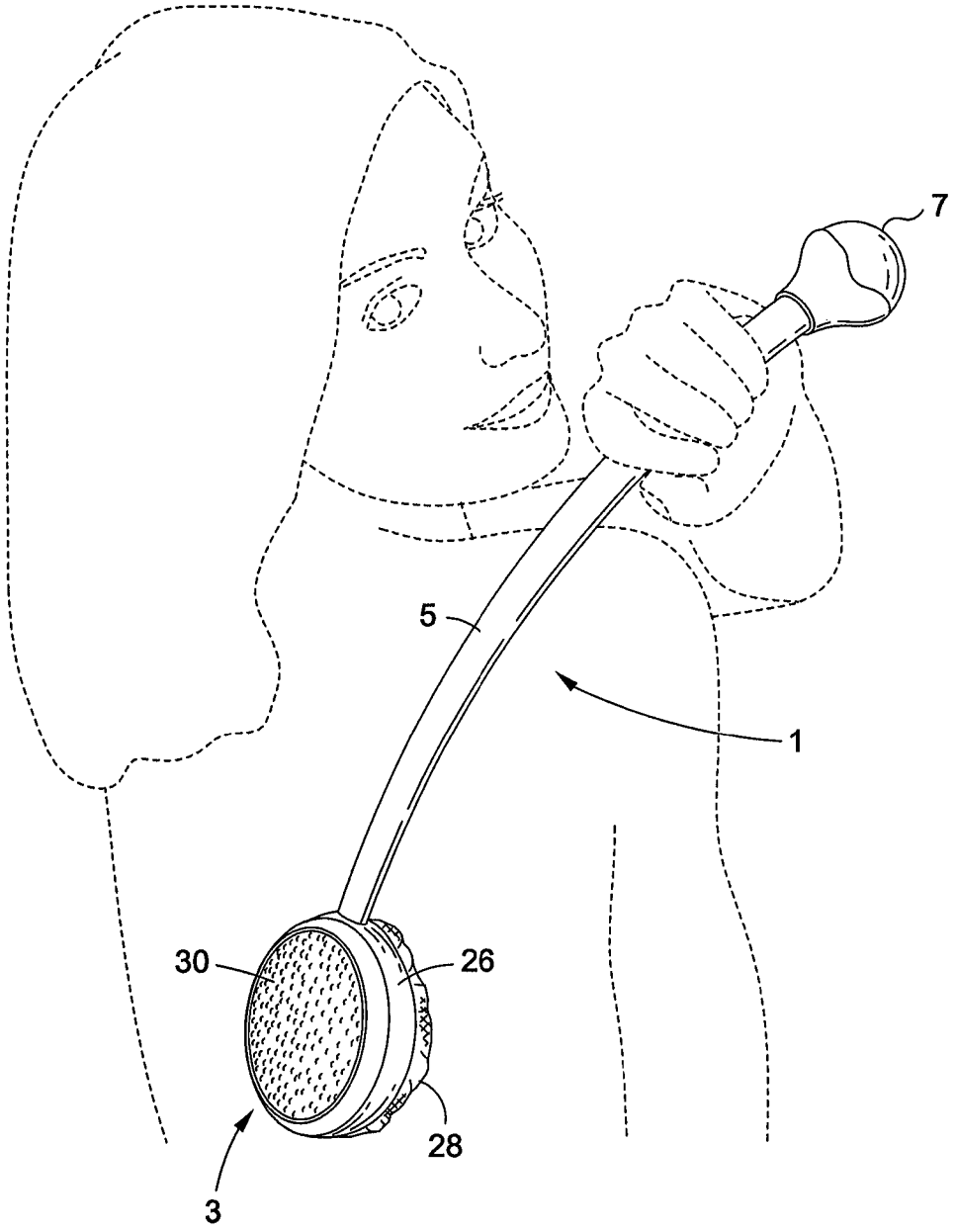
FIG. 1 shows a multi-function back and body scrubber according to a preferred embodiment of this invention having an elongated shaft to position a double-sided scrubbing head against the back of a user.
Figure 2:
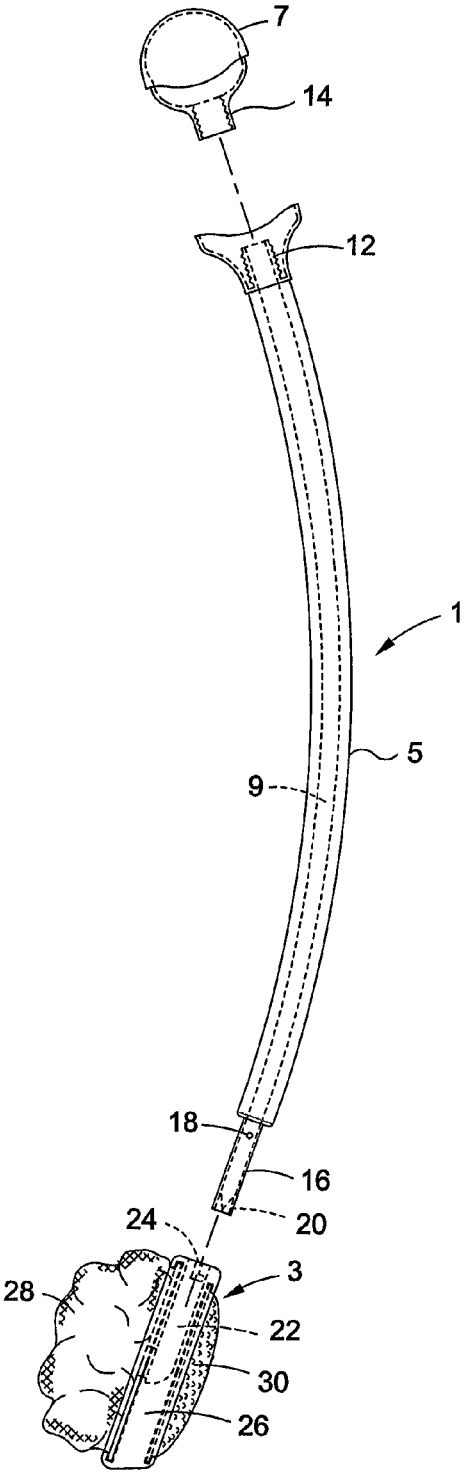
FIG. 2 is an exploded view of the multi-function back and body scrubber of FIG. 1 with a fluid reservoir being shown running through the shaft thereof.
Figure 3:
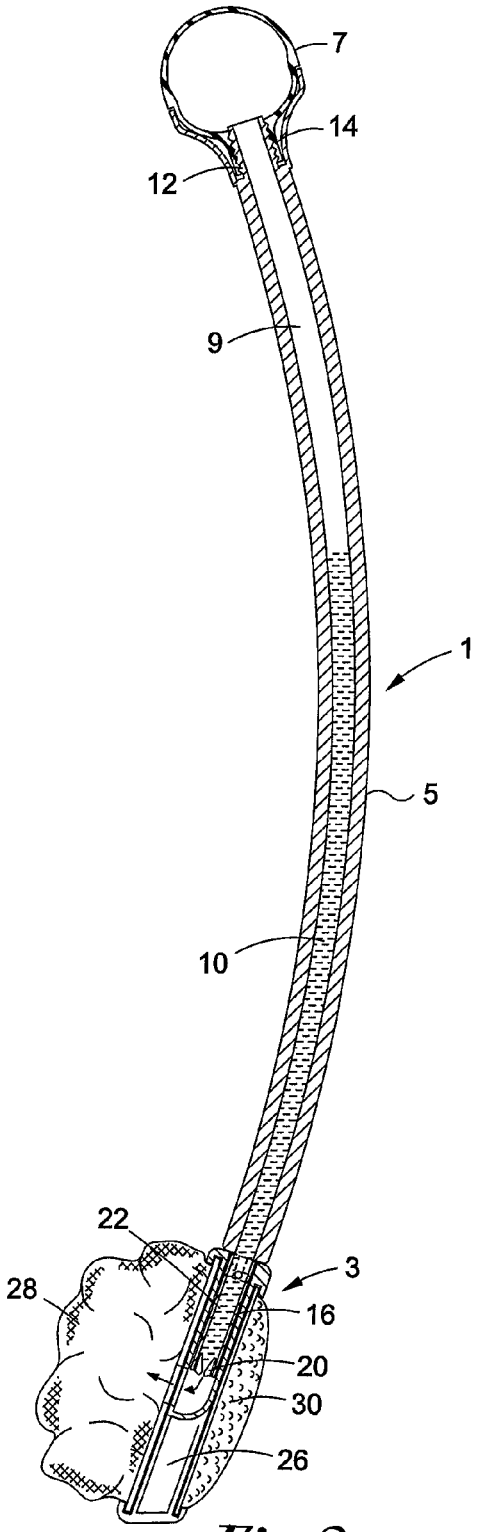
FIG. 3 shows the multi-function back and body scrubber of FIG. 2 assembled with the fluid reservoir running through the shaft thereof filled with a fluid.

A preferred embodiment for a multi-function back and body scrubber 1 according to the present invention is initially described while referring to FIG. 1 of the drawings. As will be described in greater detail hereinafter, the back and body scrubber 1 includes a double-sided scrubbing head 3 having a pair of oppositely-oriented cleaning surfaces that are adapted to vary the intensity by which a user can scrub or wash her back while taking a bath or shower. What is more the scrubbing head 3 of the back and body scrubber 1 is detachable so as to be held in the hand of the user. In this case, the scrubbing head 3 can also be used to wash other areas of the user's body.

Referring concurrently now to FIGS. 1-6 of the drawings, the multi-function back and body scrubber 1 is shown having a hollow, elongated shaft 5. A flexible thumb pump 7 is located at a first end of the elongated shaft 5 and the aforementioned double-sided scrubbing head 3 is located at the opposite end of shaft 5. The hollow, elongated shaft 5 has a length so as to enable the user to reach and easily move the scrubbing head 3 against and over her back when the shaft 5 or the thumb pump 7 of the back and body scrubber 1 is grasped in the user's hand (best shown in FIG. 1). To this end, the shaft 5 is preferably manufactured from a flexible (e.g., plastic) material so as to be capable of bending in response to a bending force applied thereto by the user. Moreover, the shaft 5 is ideally formed with an arcuate (i.e., curved) configuration so that the scrubbing head 3 will be biased towards the user's back when the scrubbing head 3 is attached to and carried by shaft 5.

The hollow, elongated shaft 5 has a fluid reservoir 9 running continuously therethrough. The fluid reservoir 9 is filled with any suitable body wash 10, such as liquid soap (best shown in FIG. 3), to be used to wash and/or scrub the user's back and body depending upon whether the scrubbing head 3 is attached to or removed from the shaft 5. However, it is to be understood that the fluid reservoir 9 can also be filled with other fluids such as body lotion and the like.

The aforementioned thumb pump 7 attached to the first end of the shaft 5 is manufactured from a flexible (e.g., rubber) material so as to generate a pumping pressure in response to the thumb pump 7 being compressed (i.e., squeezed) by the thumb or hand of the user. That is, the pumping pressure generated by squeezing the thumb pump 7 forces the body wash 10 through the fluid reservoir 9 of the shaft 5 towards the scrubbing head 3 that is detachably connected to the opposite end of the shaft 5.

In order to be able to load and refill the fluid reservoir 9 with the body wash 10, the thumb pump 7 is detachable from the shaft 5 of the back and body scrubber 1. By way of example, the first end of the shaft 5 has a threaded locking post 12 projecting therefrom. The thumb pump 7 has a correspondingly threaded cup 14 extending therefrom. The thumb pump 7 is rotated in a first direction into detachable mating engagement with the shaft 5 in response to a rotational force applied to the thumb pump 7 to cause the threaded cup 14 thereof to be coupled to the threaded locking post 12 of shaft 5 (best shown in FIG. 3). When it is necessary to refill the reservoir 9 of shaft 5, the thumb pump 7 is rotated in an opposite direction to be detached from the shaft 5 and thereby permit access to the fluid reservoir 9 thereof.

As was previously described, the double-sided scrubbing head 3 is detachably connected to the end of the elongated shaft which lies opposite the end to which the thumb pump 7 is detachably connected. More particularly, a (e.g., cylindrical) fluid reservoir extension 16 projects axially from the opposite end of the shaft 5. The reservoir extension 16 communicates with the fluid reservoir 9 running through the shaft 5 so that the body wash 10 can be forced under pressure (after the flexible thumb pump 7 is first compressed) from reservoir 9 to scrubbing head 3 via the fluid reservoir extension 16.

Figure 4:
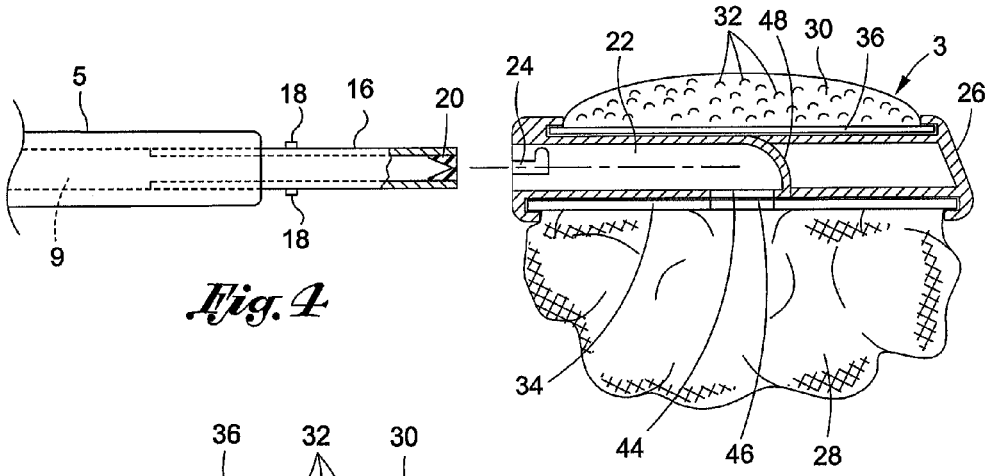
FIG. 4 is illustrative of the double-sided scrubbing head of the multi-function back and body scrubber being detachably connected to the shaft thereof.
Figure 5:
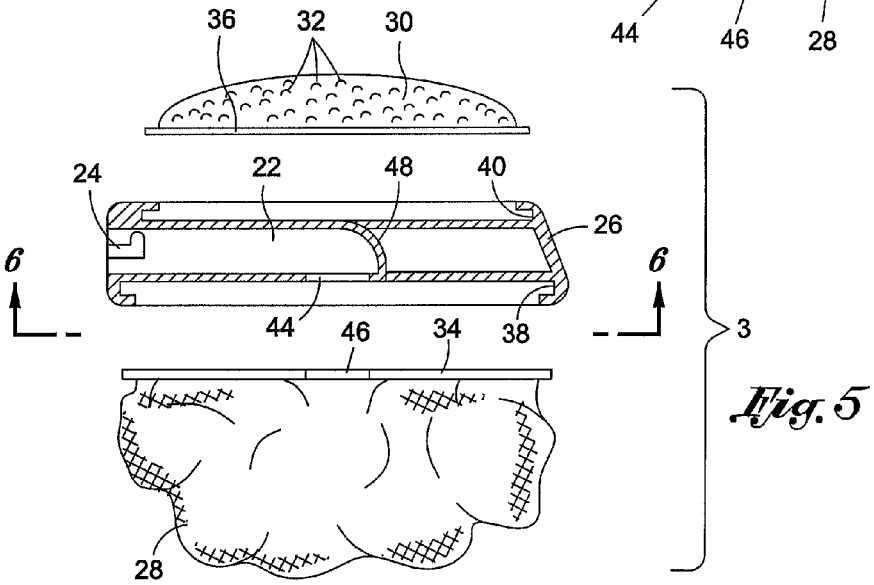
FIG. 5 is an exploded view of the double-sided scrubbing head.
Figure 6:
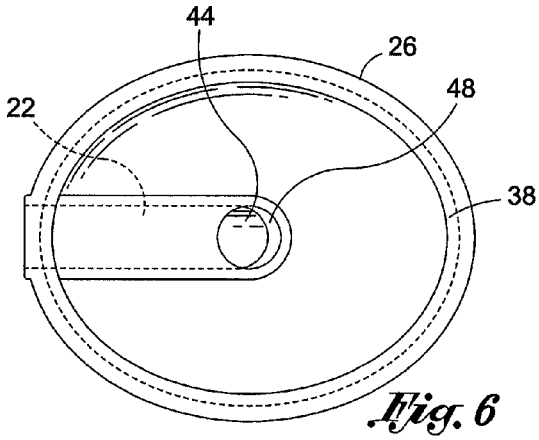
FIG. 6 shows an intermediate cleaning surface holder of the double-sided scrubbing head taken along lines 6-6 of FIG. 5.

As is best shown in FIG. 4, a pair of locking tabs 18 project radially outward from the fluid reservoir extension 16. A normally closed fluid actuator 20 is located inside the fluid reservoir extension 16 which projects from the shaft 5. As will soon be explained, the fluid actuator 20 controls the flow of body wash from the reservoir 9 of shaft 5 to the scrubbing head 5-3 depending upon whether the thumb pump 7 is being squeezed and compressed.

The double-sided scrubbing head 3 of the multi-function back and body scrubber 1 includes an intermediate cleaning surface holder 26 having a hollow (e.g., cylindrical) fluid channel 22 running longitudinally therethrough. The fluid channel 22 through the cleaning surface holder 26 is sized and shaped to slidably receive therewithin the (e.g., cylindrical) fluid reservoir extension 16 which projects from the shaft 5. The fluid reservoir extension 16 is preferably shorter than the fluid channel 22 and narrower than the shaft 5. A pair of twist-in locking slots 24 corresponding to the pair of radially-projecting locking tabs 18 of the fluid reservoir extension 16 are formed in the entrance end of the fluid channel 22. The fluid reservoir extension 16 is pushed axially inward of the hollow fluid channel 22 of the cleaning surface holder 26 so that the locking tabs 18 are received by respective ones of the twist-in locking slots 24. A rotation of the shaft 5 in a first direction rotates the locking tabs 18 which project from the fluid reservoir extension 16 into locking engagement with the twist-in locking slots 24 formed in the fluid channel 22, whereby the shaft 5 is coupled to the double-sided scrubbing head 3. A rotation of the shaft 5 in an opposite direction rotates the locking tabs 18 out of engagement with the locking slots 24 when it is desirable to detach the shaft 5 from scrubbing head 3.

First and second oppositely-facing cleaning surfaces 28 and 30 are detachably connected to opposite sides of the intermediate cleaning surface holder 26 of the double-sided scrubbing head 3. The first and second cleaning surfaces 28 and 30 are preferably manufactured from different materials which have different cleaning applications to suit the needs of the user. By way of example, the first cleaning surface 28 at one side of the cleaning surface holder 26 of scrubbing head 3 is a fluid retaining mesh material or an exfoliating loofah sponge commonly used to remove dead skin from the body of the user. By way of additional example, the second cleaning surface 30 at the opposite side of the cleaning surface holder 26 of scrubbing head 3 is a hard plastic shell having a set of upwardly standing bristles or raised bumps 32 of the kind commonly used to scrub or massage one's back.

Each of the first and second oppositely-facing cleaning surfaces 28 and 30 has a flat attachment base 34 and 36 extending therealong. Corresponding retention grooves 38 and 40 (best shown in FIG. 5) depend from opposite sides of the intermediate cleaning surface holder 26 and lie below and above the longitudinally-extending fluid channel 22 which runs therethrough. The retention grooves 38 and 40 are sized and shaped to slidably receive therewithin respective ones of the flat attachment bases 34 and 36 of the first and second cleaning surfaces 28 and 30 whereby to couple cleaning surfaces 28 and 30 to the cleaning surface holder 26. When it is desirable to separate one or both of the cleaning surfaces 28 and 30 from their attachment to holder 26, the attachment bases 34 and 36 are removed (i.e., pulled outwardly) from the respective retention grooves 38 and 40. Thus, it may be appreciated that the first and second cleaning surfaces 28 and 30 of the double-sided scrubbing head 3 are replaceable and interchangeable with one another.

A fluid exit port 44 is formed through the side of the hollow fluid channel 22 of the cleaning surface holder 26 which lies adjacent the first cleaning surface 28. In the assembled configuration of the double-sided scrubbing head 3 shown in FIG. 4, the fluid exit port 44 is axially aligned with a hole 46 that is formed through the attachment base 34 of the first cleaning surface (e.g., loofah sponge) 28. In this manner, the fluid reservoir 9 of the hollow shaft 5 of the multi-function back and body scrubber 1 lies in fluid communication with the first cleaning surface 28 to supply body wash thereto by way of a fluid path including reservoir 9, the fluid reservoir extension 16, the fluid channel 22 through the cleaning surface holder 26 within which the fluid reservoir extension 16 is slidably received, and the axially-aligned fluid exit port 44 and hole 46.

The hollow fluid channel 22 of the cleaning surface holder 26 of the scrubbing head 3 has an angled or curved wall 48 extending thereacross and being located adjacent the fluid exit port 44. Thus, body wash (designated 10 in FIG. 2) which is forced, under pressure, from the fluid reservoir extension 16 into the fluid channel 22 is directed by the wall 48 through the axially-aligned fluid exit port 44 of fluid channel 22 and the hole 46 in the attachment base 34 of the first cleaning surface 28 (e.g., loofah sponge). Accordingly, the first cleaning surface 28 of scrubbing head 3 is saturated with body wash for scrubbing and washing the user's body.

To this end, and as was earlier described, the fluid reservoir extension 16 has a fluid actuator 20 (of FIG. 4) which is normally closed so as to block the flow of body wash from the fluid reservoir 9 of shaft 5 to the first cleaning surface 28. The fluid actuator 20 is preferably manufactured from a resilient (e.g., rubber) material that is responsive to the pressure head created when the flexible thumb pump 7 is squeezed by the user and compressed in order to force body wash 10 from the fluid reservoir 9 towards the double-sided scrubbing head 3. That is, the pressure generated when the body wash moves from the fluid reservoir 9 into the fluid reservoir extension 16 forces the resilient, pressure-responsive fluid actuator 20 radially outward against extension 16. The fluid actuator 20 thereby temporarily changes its shape from its normally closed configuration at which to block the flow of body wash through the fluid reservoir extension 16 to an open configuration at which to permit the flow of body wash from the fluid reservoir extension 16 to the first cleaning surface 28, as was just explained. When the thumb pump 7 is no longer being squeezed and the fluid pressure dissipates, the fluid actuator 20 relaxes and automatically returns to its normally-closed configuration across the fluid reservoir extension 16.

As has been previously described, one or both of the first and second cleaning surfaces 28 and 30 can be separated from the intermediate cleaning surface holder 26 of the double-sided scrubbing head 3 by means of sliding the attachment bases 34 and 36 thereof out of engagement with respective ones of the retention grooves 38 and 40 formed at opposite sides of the intermediate cleaning surface holder 26. What is more, the scrubbing head 3 can be separated, with the opposing cleaning surfaces 28 and 30 still attached thereto, from the shaft 5 of the back and body scrubber 1 by rotating the locking tabs 18 of the fluid reservoir extension 16 out of their locking engagement with the twist-in locking slots 24 that are formed at the entrance end of fluid channel 22.

Figure 7:
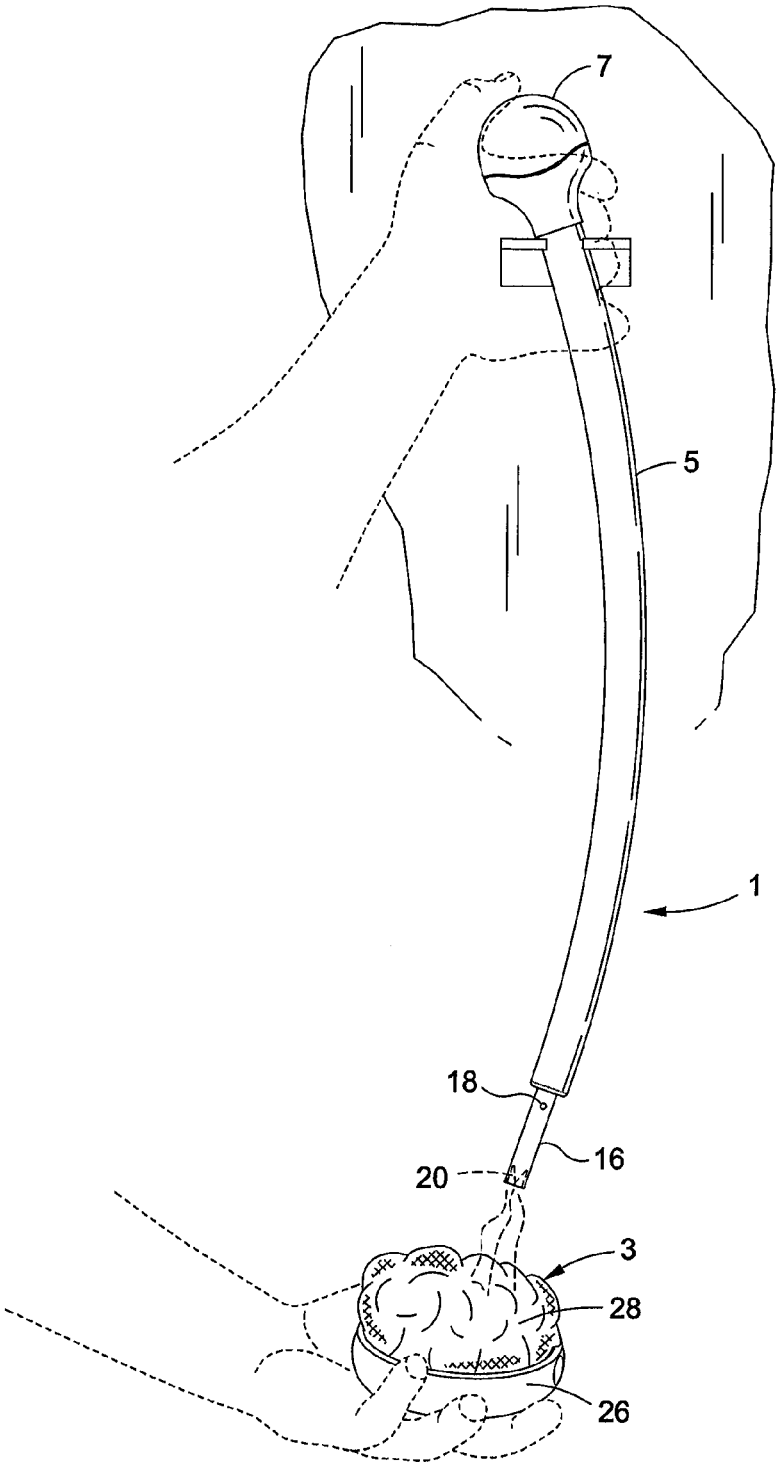
FIG. 7 shows the double-sided scrubbing head detached from the shaft of the multi-function back and body scrubber and held in the hand of the user.

FIG. 7 of the drawings shows the double-sided scrubbing head 3 separated from the shaft 5 to provide the multi-function back and body scrubber 1 with another use as a body wash applicator. In particular, instead of locating the scrubbing head 3 against the user's back by means of the elongated shaft 5, the scrubbing head can also be separated from shaft 5 and held in a hand of the user. In this case, the user can squeeze the flexible thumb pump 7 with one hand so that body wash will be dispensed under pressure from the fluid reservoir extension 16 to the first cleaning surface 28 of the double-sided scrubbing head 3 being held in the user's other hand. The first and second cleaning surfaces 28 and 30 of the hand-held double-sided scrubbing head 3 may now be used as needed to clean or scrub or massage other areas of the user's body. In the alternative, the thumb pump 7 can be squeezed in one hand to force body wash from the fluid reservoir 9 of the shaft 5 directly to the other hand of the user to enable the user to wash herself without having to handle a slippery bar of soap or access a soap dispenser.

By virtue of the multi-function back and body scrubber herein disclosed, a soap reservoir and applicator, a loofah sponge, and a body scrubber/massager are all integrated into a single easy-to-use and store appliance to avoid the necessity of having access to a variety of independent body washing appliances which have heretofor been found around a shower or bath tub.

The invention claimed is:

1. A multi-function back and body scrubber comprising:

a shaft containing a supply of fluid to be dispensed to a user;

a double-sided scrubbing head coupled to one end of said shaft to dispense the fluid from said shaft to the user;

a pump coupled to the other end of said shaft to be activated to generate a pressure for forcing the liquid from said shaft to said double-sided scrubbing head to be dispensed to the user, said double-sided scrubbing head having first and second cleaning surfaces and a cleaning surface holder, said first and second cleaning surfaces being attached to opposite sides of said cleaning surface holder and facing in opposite directions relative to one another, said cleaning surface holder having a fluid channel running therethrough and lying in fluid communication with at least one of said first and second cleaning surfaces;

said shaft including an extension slidably and removably received within the fluid channel running through said cleaning surface holder such that said extension is positioned between said first and second cleaning surfaces; and a flexible fluid actuator extending across said shaft extension and located within the fluid channel of said cleaning surface holder to block the flow of fluid from said shaft to said fluid channel within which said shaft extension is slidably and removably received, said flexible fluid actuator being responsive to the pressure generated when said $pum_p$ is activated so as to undergo a change of shape and thereby permit the flow of fluid from said shaft to said fluid channel.

2. The multi-function back and body scrubber recited in claim 1, wherein the first and second cleaning surfaces of said double-sided scrubbing head are different cleaning surfaces having different appearances.

3. The multi-function back and body scrubber recited in claim 1, wherein the first cleaning surface includes a loofah sponge and the second cleaning surface includes a plurality of raised bumps.

4. The multi-function back and body scrubber recited in claim 1, wherein said pump is detachably connected to and removable from said shaft to enable said shaft to be refilled with the liquid.

5. The multi-function back and body scrubber recited in claim 1, wherein said double-sided scrubbing head is detachably connected to and removable from said shaft extension so that said scrubbing head can be held in a hand of the user apart from the shaft.

6. The multi-function back and body scrubber recited in claim 1, wherein each of said first and second cleaning surfaces of said double-sided scrubbing head are detachably connected to and removable from the opposite sides of said cleaning surface holder, such that said first and second cleaning surfaces are replaceable and interchangeable with one another.

7. The multi-function back and body scrubber recited in claim 6, wherein the cleaning surface holder of said double-sided scrubbing head has first and second retention grooves located at the opposite sides thereof, said first and second cleaning surfaces being detachably connected to said cleaning surface holder at respective ones of said first and second retention grooves.

8. The multi-function back and body scrubber recited in claim 1 wherein there is a fluid exit port formed in the fluid channel running through the cleaning surface holder of said double-sided scrubbing head, whereby said shaft lies in fluid communication with the one of said first and second cleaning surfaces by way of a fluid path including said shaft extension, said fluid channel and said fluid exit port.

9. The multi-function back and body scrubber recited in claim 8, further comprising a flow diverting wall located across the fluid channel of said cleaning surface holder so as to direct fluid from said shaft to the one of the first and second cleaning surfaces of said double-sided scrubbing head by way of said fluid exit port formed in said fluid channel.

10. The multi-function back and body scrubber recited in claim 1, wherein the shaft extension includes at least one locking tab projecting therefrom and the fluid channel running through said cleaning surface holder includes at least one locking slot formed therein, said one locking tab being rotatable into locking engagement with said one locking slot such that said shaft extension is detachably connected to said scrubbing head when said shaft extension is slidably and removably received by said fluid channel.

11. The multi-function back and body scrubber recited in claim 10, wherein the one locking tab of said shaft extension is rotatable out of said locking engagement with said one locking slot to enable said double-sided scrubbing head and said cleaning surface holder thereof to be detached from said shaft extension and fluid to be dispensed directly to said scrubbing head from said shaft extension when said pump is activated.

12. The multi-function back and body scrubber recited in claim 1, wherein said shaft is manufactured from a flexible material having a curved configuration so as to bend in response to a bending force applied thereto to enable said double-sided scrubbing head to move over and against the back of the user.

13. A multi-function back and body scrubber comprising:

a hollow shaft in which a fluid reservoir is established for storing a supply of fluid to be dispensed to a user;

a double-sided scrubbing head detachably connected to a first end of said hollow shaft at which to dispense the fluid from the fluid reservoir of said hollow shaft to the user;

a pump connected to the opposite end of said hollow shaft so as to lie opposite the first end of said shaft to which said double-sided scrubbing head is detachably connected, said pump being compressed to generate a pressure for forcing the fluid from the fluid reservoir of said hollow shaft to the double-sided scrubbing head to be dispensed to the user, said pump being separated from said double-sided scrubbing head by the fluid reservoir of said hollow shaft;

said double-sided scrubbing head having first and second cleaning surfaces facing in opposite directions relative to one another;

a fluid exit port located within said double-sided scrubbing head so as to lie between said hollow shaft and at least one of the first and second cleaning surfaces of said double-sided scrubbing head, the first end of said hollow shaft to which said double-sided scrubbing head is detachably connected being removably received within said scrubbing head so as to lie between said first and second cleaning surfaces and in fluid communication with said fluid exit port; and a flexible fluid actuator extending across the first end of said hollow shaft and being located within said double-sided scrubbing head to block the flow of fluid from the fluid reservoir of said hollow shaft to said fluid exit, port, said flexible fluid actuator being responsive to the pressure generated when said pump is compressed so as to undergo a change of shape and thereby permit the flow of fluid from the fluid reservoir of said hollow shaft to the one of said first and second cleaning surfaces of said double-sided scrubbing head by way of said fluid exit port.

* * * * *